United States Patent [19]

Leblanc et al.

[11] 4,387,686

[45] Jun. 14, 1983

[54] FUEL INJECTION APPARATUS FOR INTERNAL COMBUSTION ENGINES, IN PARTICULAR FOR DIESEL ENGINES

[75] Inventors: Jean Leblanc, Lyons; Jean Pigeroulet, Villeurbanne, both of France; Max Straubel; Konrad Eckert, both of Stuttgart, Fed. Rep. of Germany

[73] Assignee: Robert Bosch GmbH, Stuttgart, Fed. Rep. of Germany

[21] Appl. No.: 223,954

[22] Filed: Jan. 27, 1981

[51] Int. Cl.[3] ..... F02M 41/02

[52] U.S. Cl. ..... 123/446; 123/449; 123/459

[58] Field of Search ..... 123/446, 449, 459, 460

[56] References Cited

U.S. PATENT DOCUMENTS

| | | | |
|---|---|---|---|
| 3,011,489 | 12/1961 | Bessiere | 123/446 |
| 3,358,662 | 12/1967 | Kulke | 123/449 |
| 3,404,668 | 10/1968 | Eheim et al. | 123/449 |
| 3,465,737 | 9/1969 | Dreisin | 123/453 |
| 3,486,493 | 12/1969 | Dreisin | 123/448 |
| 3,486,494 | 12/1969 | Dreisin | 123/457 |
| 3,620,647 | 11/1971 | Hofer et al. | 123/446 |
| 3,667,438 | 6/1972 | Moulin et al. | 123/447 |
| 3,699,939 | 10/1972 | Eckert et al. | 123/459 |
| 3,921,604 | 11/1975 | Links | 123/458 |
| 4,249,497 | 2/1981 | Eheim et al. | 123/446 |

FOREIGN PATENT DOCUMENTS 1185828 11/1957 France ..... 123/446

*Primary Examiner*—Ira S. Lazarus
*Assistant Examiner*—Magdalen Moy
*Attorney, Agent, or Firm*—Edwin E. Greigg

[57] ABSTRACT

A fuel injection apparatus (FIG. 1) for internal combustion engines is proposed, in which the onset and end of injection are determined by means of a hydraulically actuated control slide. The injection pumps of the apparatus, preferably combined with an injection nozzle to make a pump/nozzle unit, have a central control fuel source represented by a supply pump and a first pressure limitation valve, which generates a control pressure ($p_S$) actuating the control slide which is several times greater than the supply pressure ($p_V$) determined by a second pressure limitation valve. In order to initiate the onset of injection, the control slide is placed under control pressure ($p_S$) by a valve assembly via a distributor apparatus and closes an overflow channel leading out of the pump work chamber. In order to control the end of injection, the control slide during its return stroke again relieves this overflow channel toward a low-pressure line. The control pressure ($p_S$) in the control pressure line required for actuating the stroke movement of the control slide is established by means of blocking the outflow out of this line by means of the valve assembly.

18 Claims, 10 Drawing Figures

FUEL INJECTION APPARATUS FOR INTERNAL COMBUSTION ENGINES, IN PARTICULAR FOR DIESEL ENGINES

BACKGROUND OF THE INVENTION

The invention is based on a fuel injection apparatus for internal combustion engines including a mechanically driven pump piston of an injection pump, a pump work chamber in the pump, a control slide limited by a pressure chamber and actuatable by control pressure of a source of control fuel common to all pumps counter to the force of at least one restoring spring, the control slide being located in a discharge channel in communication with the pump work chamber and arranged to close the discharge channel at will to initiate the variable onset of injection, and to open the channel again to terminate the injection, and a control apparatus for exerting pressure via the control lines on the pressure chambers of the control slides. A fuel injection apparatus of this type is already known (U.S. Pat. No. 3,486,493) in which the injection pump is embodied as a pump/nozzle, and the fuel injection quantity is determined by a hydraulically driven control slide inserted into an overflow channel. This control slide determines the effective supply stroke, and thus the fuel injection quantity of the injection pump, by means of blocking the return flow of fuel out of the pump work chamber; and the injection is terminated whenever this control slide opens the overflow channel and the injection pressure can be relieved. In the known apparatus, the control slide is exposed to the supply pressure of the supply pump, and it is actuated by means of pressure relief in its spring chamber containing the restoring spring. In order to initiate the onset of injection, it is thus only the actuation force resulting from the supply pressure minus the force of the restoring spring that is available; and in order to terminate the injection, only the force of the restoring spring is available, because both end faces of the control slide are placed under identical pressure at the end of injection. This restricts the applicability of such an apparatus in high-speed engines. A further disadvantage is that the control pressure line also acts as a filling line, so that retroactive influences on the control must be expected.

A fuel injection apparatus of virtually the same type is known from U.S. Pat. No. 3,465,737; however, in this apparatus the control slide is actuated by the control pressure of a separate injection pump, which acts as the control pump and is driven simultaneously with the pump/nozzle unit. In order to vary the onset of injection, a known injection adjuster which transmits the drive torque is built into the drive mechanism of the control pump, so the total expenditure for the apparatus is very high. It is the object of the invention to obtain a compact injection apparatus at low manufacturing cost, wherein it is possible to exclude mechanical control elements, and which can be used in high-speed Diesel engines.

OBJECT AND SUMMARY OF THE INVENTION

In the fuel injection apparatus according to the invention and having the characteristics of the main claim, a sufficiently high control pressure is available, permitting rapid actuation of the control slide, without requiring an additional control pump which would need a separate drive mechanism. By initially adjusting the first pressure limitation valve to a control pressure of approximately 30 to 80 bar and the second pressure limitation valve to 6 bar, for example, and by disposing the control pressure lines and the filling lines separately, it is possible to obtain rapid and precise fuel injection which is also suitable for use in high-speed Diesel engines. As a result of the separation of the valve assembly controlling the exertion of pressure from the distributor apparatus, the necessary lines and control times can be optimally dimensioned.

As a result of the characteristics disclosed in the dependent claims, structural embodiments and improvements as well as advantageous modifications of the fuel injection apparatus disclosed are possible. Thus, in accordance with one modification, a constant-quantity pump is used as a supply pump, which furnishes both the injection quantity and the control fuel quantity and is capable of generating the necessary control pressure.

A simplified disposition of the lines is attained by means of the characteristics of other modifications. For example, a second modification provides that the relief surges occurring upon reversal of the control slide, and these reversal movements themselves, are damped. A third modification provides that the overflow channel will simultaneously serve the purpose of filling the pump work chamber, while a fourth provides that a portion of the filling channel is replaced by channels on the control slide.

The throttle line which connects the pressure chamber of the control slide with its spring chamber in accordance with a fifth modification assures that the control slide, in its non-actuated state, always remains located in its outset position and is thus not susceptible to leakage flows. In contrast to this, another modification assures that the fuel escaping under high pressure during the relief of the pump work chamber does not proceed directly into the spring chamber of the control slide, which would unfavorably influence the control movement of this control slide.

A seventh modification provides that an electrical control of the injection onset and of the injection quantity can be attained with a single magnetic valve assembly; and with the magnetic valves, of a type which is already available, arranged in accordance with an eighth modification, extremely short switching times are attained.

Further disclosed modifications define various possible combinations of magnetic valves. In at least one selected combination a clear separation between control pressure and supply pressure is enabled, thus assuring more rapid stroke movement on the part of the control slide, as a result of the use of a 3/2-way valve inserted into the control pressure line. In another combination 2/2-way valves can be used, which are very simple in design, and a simple disposition of lines can be used.

The characteristics of still another modification assure rapid actuation of the magnetic valve controlling the onset or the end of injection, as the case may be; and if the electric current fails, no injection can take place, so that due consideration is paid to safety requirements.

In a fuel injection apparatus of the type described having a central rotary distributor acting as the distributor apparatus and driven in synchronism with the injection pumps, this rotary distributor establishes and breaks a connection of the individual control lines with the control pressure line in order to actuate the control slides in sequence in synchronism with the injections, and the necessary distributor function is attained through applying the characteristics of yet another modification. Because this rotary distributor is then required only to perform a distributor function, only limited demands for precision must be made of this component.

If the injection apparatus as described is equipped with a central valve assembly having a rotary distributor as known from U.S. Pat. No. 3,486,493 mentioned above, with this valve assembly determining the duration of control slide actuation, then the characteristics of still another modification provide for a disposition of lines and an opportunity for actuation which are simplified substantially in comparison with the prior art.

In two other modifications, a fuel injection apparatus is disclosed which has a valve assembly having a rotary distributor in which in an advantageous manner the metering slide, actuatable solely for the purpose of varying the supply quantity and the injection onset, does not rotate along with the drive mechanism and thus can be actuated in a simple manner by known electrical or mechanical adjusting members. The particular advantage of this arrangement resides in the exact separation between the mechanically or electrically actuated adjusting members which vary the injection onset and those which control the supply quantity.

And according to two further modifications, the distributor apparatus embodied by one control location on each pump piston makes it possible to provide an automatic connection, in the simplest possible manner, between the control pressure line and the particular pressure chambers needing to be placed under control pressure at a particular time; also, the length of the control line may advantageously be kept extremely short, which means that the dead spaces in the control lines are reduced in size, and a drive mechanism which would otherwise be required for the distributor apparatus can be eliminated.

The invention will be better understood and further objects and advantages thereof will become more apparent from the ensuing detailed description of preferred embodiments taken in conjunction with the drawings.

DESCRIPTION OF THE PREFERRED EMBODIMENTS

Figures 1, 1A:
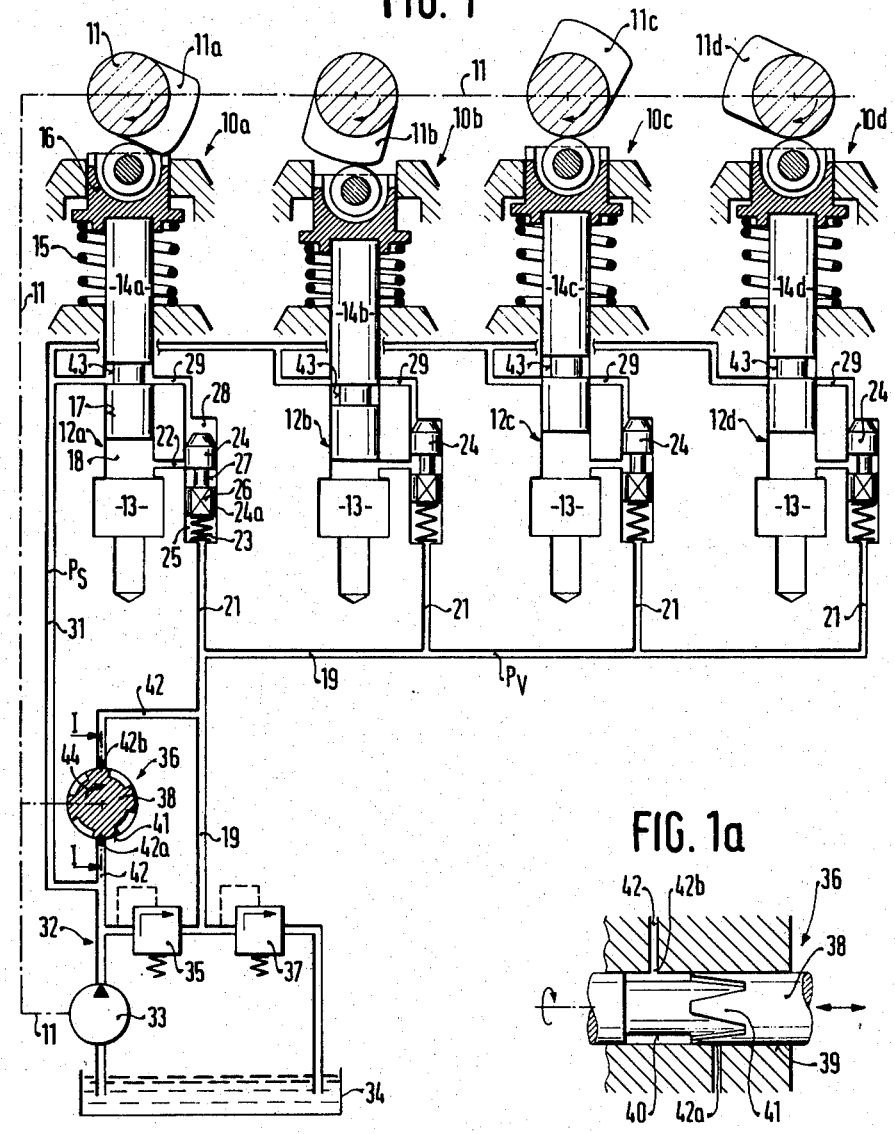
FIG. 1 is a simplified representation of the first exemplary embodiment having four injection pumps, shown in cross section and embodied as pump/nozzles, and a mechanical distributor.
FIG. 1*a* is a partial section taken along the line I—I of FIG. 1.

In the fuel injection apparatus shown in FIG. 1, four mechanically driven pump/nozzles 10*a*–10*d* are shown, which substantially comprise four injection pumps 12*a*–12*d*, embodied as piston pumps and each driven by one drive cam 11*a*–11*d* of an engine camshaft 11, and four injection nozzles 13 combined together with the pumps 12 as a unit and embodied as pressure-controlled injection valves. Any of the known, fuel-controlled injection nozzles embodied as valves opening inward or outward can be used as the injection nozzle, depending on the particular requirements of the engine. The pump pistons 14*a*, 14*b*, 14*c*, 14*d*, during their compression strokes generated by the drive cams 11*a*–11*d* counter to the force of a push rod spring 15 and transmitted via roller push rods 16, each dip into one pump work chamber 18 embodied by a portion of the cylinder bore 17 of the pump pistons 14*a*–14*d*. These pump work chambers 18 are filled with fuel via filling lines 21 connected to a supply line 19 which is common to all the pump/nozzles 10*a*–10*d* and which is subject to the supply pressure $p_V$; these filling lines 21 are at the same time to be considered an extension of the overflow channels 22 which are connected to the pump work chambers 18. Since in the illustrated embodiment no separate filling lines discharge into the pump work chambers 18, the overflow channels 22 should also be considered as a portion of the filling lines 21. A control slide 24 actuatable counter to the force of a restoring spring 23 is inserted into the connection between each overflow channel 22 and the filling line 21. In the case of the pump/nozzle 10*a*, this control slide 24 is in a position in which, in order to initiate injection, it closes the overflow channel 22. In the case of the other pump/nozzles 10*b*–10*d*, however, the control slide is in its outset position in which it connects the pump work chamber 18 with the filling lines 21 and thus with the supply line 19 serving as a low-pressure line. In order to simplify filling of the lines, the filling lines 21 each discharge into one spring chamber 25, containing the restoring spring 23, of the control slide 24, and the spring chamber 25 is in permanent communication, via channels 26 embodied by faces or grooves in a section 24*a* of the control slide 24, with a control location 27, embodied as an annular groove, of the control slide 24. In the outset position of the control slide 24 shown in connection with the pump/nozzles 10*b*–10*d*, the annular groove 27 has opened the connection between the filling line 21 and the overflow channel 22; in the case of the first pump/nozzle 10*a*, this connection is closed.

Each of the control slides 24 is limited on its end opposite the restoring spring 23 by a pressure chamber 28, which in turn is connected via a control line 29 to a control pressure line 31 which is common to all the pump/nozzles.

The control pressure line 31 may be placed under the control pressure $p_S$ of a source of control fuel 32 whenever the fuel supplied by a supply pump 33 from a tank 34 into the control pressure line 31 has its pressure level determined by a first pressure limitation valve 35. This is the case whenever the control fuel located in the control pressure line 31 is prevented by a valve assembly 36 from flowing out into a low-pressure line which is under substantially lower pressure. In the illustrated embodiment, the supply line 19 acts as the low-pressure line, and in the present case it is the supply pressure $p_V$ which then prevails in this line. In order to control this supply pressure $p_V$, a second pressure limitation valve 37 is switched subsequent to the first pressure limitation valve 35.

The control fuel source 32 is thus embodied by the supply pump 33, itself preferably embodied as a constant-quantity pump, and the first pressure limitation valve 33; the control pressure $p_S$ which prevails in the control pressure line 31 when the return flow has been blocked is several times higher than the supply pressure $p_V$ prevailing in the supply line 19 and in the filling lines 21. Favorable values for these pressures are $p_V=6$ bar and $p_S=30$ to 80 bar.

The central valve assembly 36 for all the pump/nozzles 10*a*–10*d* has a rotary distributor 38, which is simultaneously driven with the camshaft 11 in synchronism with the injection pumps 12*a*–12*d*. The distributor is longitudinally displaceable for the purpose of varying the supply quantity and can also be rotated by its drive mechanism for the purpose of varying the injection onset. As may be understood from FIGS. 1 and 1*a*, the revolving rotary distributor 38 is provided on its jacket face 39 with four control faces 41; that is, the rotary distributor 38 has one control face 41 each for each control line 29 which is to be opened. The valve assembly 36 is inserted into a line 42 connecting the control pressure line 31 with the supply line 19 which acts as the low-pressure line; a control port 42*a* of the line 42 which communicates permanently with the control pressure line 31 is controlled by the control faces 41 on the rotary distributor 38, and another control port 42*b*, leading to the low-pressure line 19, communicates permanently with a recess 40 defined on the rotary distributor 38 by the control faces 41. If one of the control faces 41 closes the control port 42*a*, then the control pressure $p_S$ limited by the first pressure limitation valve 35 is established in the control pressure line 31, and this pressure is then directed as shown in FIG. 1, via an annular groove 43 on the pump piston 14*a* which serves as a distributor apparatus and further via the control line 29 into the pressure chamber 28 of the first pump/nozzle 10*a*. FIG. 1 shows the injection onset position for the first pump/nozzle 10*a*, because the fuel located in the pump work chamber 18 is prevented by the control slide 24, which is blocking the overflow channel 22, from flowing out into the low-pressure line 19. In the course of the further downward stroke of the pump piston 14*a*, the fuel compressed within the pump work chamber 18 is subsequently injected via the injection nozzle 13 into the associated engine cylinder. In the case of the remaining pump/nozzles 10*b*–10*d*, which are not actuated, the connection from the control pressure line 31 to the pressure chamber 28 of the control slide 24 is blocked, either in the bottom dead center position or the top dead center position of the associated drive cam 11*b*–11*d*, as a result of the corresponding position of the associated annular grooves 43 on the pump pistons 14*b*–14*d*. The distributor apparatus embodied by the four annular grooves 43 on the pump pistons 14*a*–14*d* and the central valve assembly 36 together comprise the control apparatus controlling the onset and end of supply of the various pump/nozzles 10*a*–10*d*.

If the rotary distributor 38 rotates clockwise out of the position shown in FIG. 1 in the direction of the arrow 44, then in order to control the end of injection, if the control face 41 no longer closes the control port 42*a*, the control pressure line 31 is relieved of pressure toward the supply line 19 via the recess 40 (FIG. 1*a*) on the rotary distributor 38, the control port 42*b* and the corresponding portion of the line 42. As a result, the pressure in the control pressure line 31 is reduced to the supply pressure $p_V$, and the pressure is dropped in the pressure chamber 28 of the first pump/nozzle 10*a*, which still communicates via the annular groove 43 and the control line 29 with the control pressure line 31, so that the restoring spring 23 can displace the control slide 24 back into its outset position. In the course of this, the pump work chamber 18 is made to communicate with the supply line 19 via the overflow channel 22, the control location 27 on the control slide 24, the channels 26, the spring chamber 25 and the filling line 21. The pressure drop thus effected in the pump work chamber 18 terminates the injection, and only a standby pressure corresponding to the supply pressure $p_V$ is maintained in the pump work chamber 18. Until the end of the remaining stroke of the pump piston 14*a*, the excess fuel is forced out of the pump work chamber 18 into the supply line 19 and during the subsequent intake stroke this pump work chamber 18 is refilled via the filling line 21 and the overflow line 22. This filling process ends when the pump piston 14*a* is again in its bottom dead center position, as is the case with the pump pistons 14*c* and 14*d* of the third and fourth pump/nozzles 10*c* and 10*d*.

The drive cams 11*a*–11*d* are embodied in such a way that both in the top dead center position and the bottom dead center position the pump piston 14*a*–14*d* remains stationary for a relatively long time, so that it it assured that when one of the control slides 24 is being actuated some other control slide 24 will not also be affected, because both in the top dead center position and the bottom dead center position, the annular groove 43 on the pump pistons 14*a*–14*d* closes the connection from the pressure chamber 28 via the control line 29 to the common control pressure line 31.

In the illustrated embodiment, the individual pump/nozzles 10*a*–10*d* are actuated directly by the drive cams 11*a*–11*d*, which are indicated by dot-dash lines and preferably interconnected and driven by the camshaft 11 embodied as an overhead engine camshaft. As a result, the "stiff drive" necessary for generating high injection pressures is assured. Naturally, the pump pistons 14*a*–14*d* can also be driven by the drive cams 11*a*–11*d* via tilting levers (not shown) which are already known. The rotary distributor 38 is advantageously also driven by the same engine camshaft 11, and a spatially favorable disposition of the fuel injection apparatus as a whole is provided if the supply pump 33 as well is driven by the engine camshaft 11, as indicated by dot-dash lines at the supply pump 33.

In the following further exemplary embodiments described in connection with FIGS. 2–4, identical elements or those having the identical function are given identical reference numerals, while those whose structure has been modified are given a prime, and new elements are provided with new reference numerals.

In the second exemplary embodiment described in connection with FIG. 2, the pump/nozzles 10*a*–10*d* are structurally identical to those shown in FIG. 1 for the first exemplary embodiment, and the control fuel source 32 also functions in the same manner. In this second embodiment, four drive cams 11*a*–11*d* are again shown, interconnected via the engine camshaft 11, and the control lines 29, all of equal length, for each pump/nozzle 10*a*–10*d* are capable of being connected to the control pressure line 31 by means of the annular grooves 43 on the pump pistons 14*a*–14*d*, which serve as the distributor apparatus. However, the valve assembly in this case is a magnetic valve assembly 48 comprising two magnetic valves 46 and 47, which is to be considered part of the control apparatus and by means of which the output of the control fuel out of the control pressure line 31 to the supply or low-pressure line 19, which is under supply pressure $p_V$, is blocked when the magnetic valves 46 and 47 are in the illustrated position. As a result, the control pressure $p_S$ prevails in the control pressure line 31 and in the pressure chamber 28 of the first pump/nozzle 10*a*, because the drive cam 11*a* has already moved the pump piston 14*a* of the first pump/nozzle 10*a* so far that the annular groove 43 has connected the associated control line 29 with the control pressure line 31 and the control slide 24 has been moved into the illustrated position, which blocks the overflow line. At the same time, the control lines 29, which are not under control pressure, associated with the other pump/nozzles 10*b*–10*d* driven by the drive cams 11*a*–11*d* and located in the top or bottom dead center positions are separated, as a result of the corresponding position of the associated annular grooves 43, from the control pressure line 31 which is under control pressure $p_S$. The magnetic valve assembly, as may be seen from the simplified illustration of FIG. 2, comprises the two magnetic valves 46 and 47 switched hydraulically in parallel, by means of which when there is an appropriate overlapping of the control signals it is possible to attain control times which would not be attainable if only a single magnetic valve were used.

Figures 2, 2A:
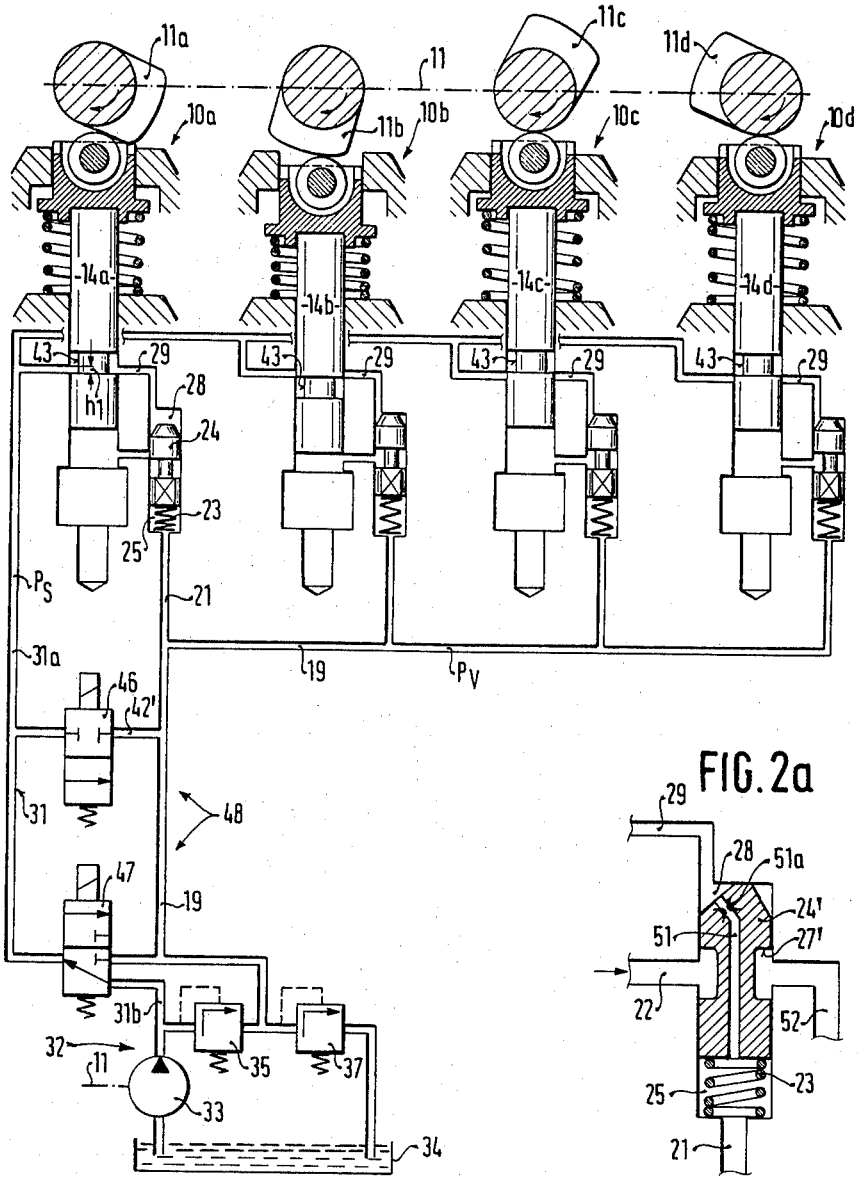
FIG. 2 is a simplified representation of the second exemplary embodiment having a valve assembly comprising two magnetic valves.
FIG. 2*a* shows a variant embodiment of the control slide used in the embodiments of FIGS. 1, 2 and 4, which has a separate relief line.

The first magnetic valve 46 is embodied as a 2/2-way valve and is shown in FIG. 2 in its actuated switching position, that is, its second position in which it has been displaced by the associated excited electromagnet and blocks the connection from the control pressure line 31 to the supply line 19. The second magnetic valve 47 is a 3/2-way valve and in its non-excited, first switching position shown in FIG. 2 it connects the first portion 31*a* of the control pressure line, leading to the annular groove 43, with the other portion 31*b* which communicates with the source of control fuel 32. In order to terminate the injection and relieve the control pressure line 31, this second magnetic valve 47, when the electromagnet is excited, switches into its second position in which it connects the portion 31*a* of the control pressure line 31 with the supply line 19. Before the next injection procedure is initiated, the first magnetic valve 46, with the electromagnet in the non-excited state, then returns to its first switching position indicated in the switching symbol and the second magnetic valve 47 is returned to its illustrated first position, again with the electromagnet in the non-excited state.

In FIG. 2*a*, a variant realization of the control slide 24 used in all the exemplary embodiments is shown and is here given reference numeral 24'. This control slide 24' contains a throttle line 51 which is substantially drilled through its longitudinal axis and which connects the pressure chamber 28 with the spring chamber 25 containing the restoring spring 23. This throttle line 51 is made so narrow that leakage fuel passing from the control line 29 into the pressure chamber 28 when the distributor apparatus 43 is blocked can overflow into the spring chamber 25, but the actuation of the control slide 24' when the pressure chamber 28 is under control pressure $p_S$ is not thereby impaired. The throttle line 51 may be embodied entirely as a throttle; however, it is more favorable for the portion of this line extending in the axial direction to be dimensioned somewhat larger, while only a short portion of this line, indicated in FIG. 2*a* by reference numeral 51*a*, is embodied as a flow throttle. Deviating from the control slide 24 shown in FIGS. 1 and 2 and which will also be shown in FIG. 4, the control slide 24' of FIG. 2*a* is provided, independently of the presence of a throttle line 51, with an annular groove 27' which is sealed off from the spring chamber 25 containing the restoring spring 23, by means of which annular groove 27' the overflow channel 22 can be connected with a separate relief line 52. This relief line 52 may lead directly back to the tank 34 and accordingly be under atmospheric pressure, or it may discharge at a suitable point into the filling line 21 or into the supply line 19, so that direct influence of the spring chamber 25 and influence on the stroke movement of the control slide 24' or 24 can be avoided.

Figure 3:
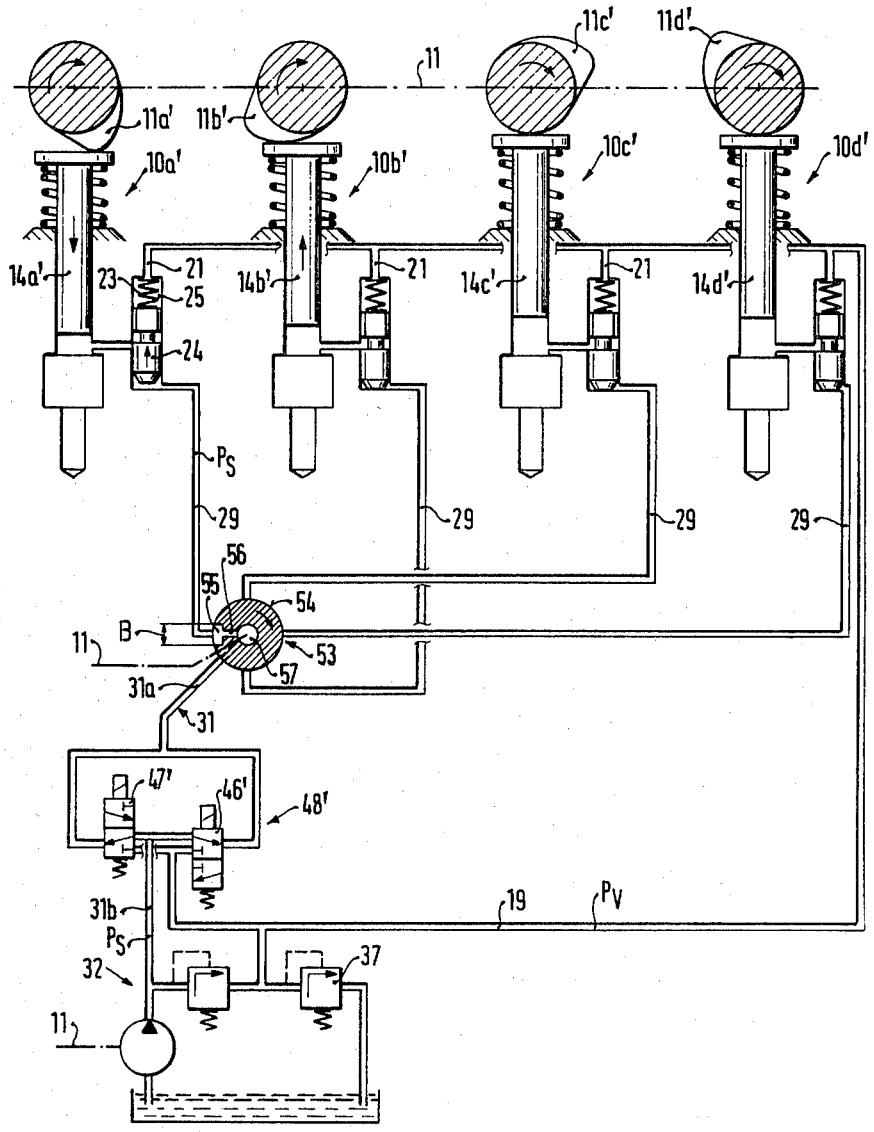
FIG. 3 shows the third exemplary embodiment, having a magnetic valve assembly and a distributor apparatus embodied by a rotary distributor.

In the third exemplary embodiment shown in FIG. 3, the pump pistons 14*a'*–14*d'* of the pump/nozzles 10*a'*–10*d'* are driven by drive cams 11*a'*–11*d'* whose shape deviates from that of the drive cams 11*a*–11*d* shown in FIGS. 1 and 2. A central rotary distributor 53, driven in synchronism with the pump/nozzles 10*a'*–10*d'*, serves as the distributor apparatus and is likewise connected directly or indirectly to the engine camshaft 11. A jacket face 54 of this rotary distributor 53 is provided with a control port 55 which is in permanent communication with the control pressure line 31, and the width B of this control port 55, viewed in the circumferential direction, is dimensioned for the longest possible actuation duration of the control slide 24, while taking into consideration rpm levels which occur in practice. The control port 55 communicates permanently via a transverse bore 56 in the rotary distributor 53 and via a longitudinal bore 57 with the control pressure line 31; and upon a rotary movement of the rotary distributor in the clockwise direction intended for driving the pump/nozzles 10*a'*–10*d'*, the individual control lines 29 are connected in sequence, in synchronism with the injection, with the control pressure line 31 by means of the control port 55. The magnetic valve assembly inserted into the control pressure line 31 between the portion 31*a* leading to the distributor apparatus 53 and the portion 31*b* of this line 31 supplied by the source of control fuel 32 is indicated in FIG. 3 by reference numeral 48'. It comprises two 3/2-way valves 46' and 47', by means of which the first portion 31*a* of the control pressure line 31, which communicates permanently with the distributor apparatus 53, can be made alternatively to communicate with the other portion 31*b* of the control pressure line 31 which is connected to the control fuel source 32, or with the low-pressure or supply line 19. In FIG. 3, the first magnetic valve 46', which is actuated to initiate the onset of injection, is shown in its switching position in which it prevents the discharge of fuel from the control pressure line 31 into the low-pressure line 19, but enables the passage of the control fuel from the control fuel source 32 to the rotary distributor 53. The second magnetic valve 47' has already been placed in this corresponding switching position at this time, and in order to terminate the injection the second magnetic valve 47' may switch over (not shown) into a position which permits the relief of the control pressure $P_S$ into the portion 31*a* of the control pressure line 31 leading to the rotary distributor 53. In this switching position, a connection is then established with the supply line 19, in which the supply pressure $P_V$ which is substantially lower than the control pressure $P_S$ prevails; as described above in connection with FIG. 1, this is controlled by the pressure limitation valve 37.

Figure 4:
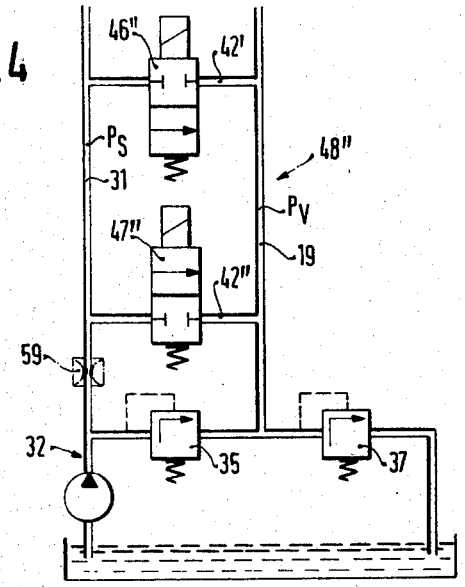
FIG. 4 is a detail of the fourth exemplary embodiment, having a simplified magnetic valve assembly.

FIG. 4 shows a magnetic valve assembly 48'' which is simplified in terms of switching technology in comparison with the magnetic valve assemblies 48 or 48' shown in FIGS. 2 and 3. This valve assembly 48'' comprises two virtually identical magnetic valves 46'' and 47'', embodied as 2/2-way valves. The two magnetic valves 46'' and 47'' are inserted into the lines 42' and 42'' connecting the control pressure line 31 with the supply line 19. Corresponding to the switching positions of the magnetic valves shown in FIGS. 2 and 3, the first magnetic valve 46'' is in its second position, with the electromagnet excited, in which the connection from the control pressure line 31 to the low-pressure line 19 is blocked, while the second magnetic valve 47'', which is not excited, is already in its first switching position which blocks this connection. As may be seen from FIG. 4, the control pressure line 31 communicates directly with the control fuel source 32, and the supply line 19 branches off between the two pressure limitation valves 35 and 37. In order to improve the operation of the valve assembly 48'', a flow throttle 59 may be inserted, as indicated by dot-dash lines, into the control pressure line 31 ahead of the connection effected via the lines 42' and 42'' with the supply line 19. This flow throttle 59 must be dimensioned such that a pressure drop in the control pressure line 31 to the supply pressure $P_V$, which enables the return stroke of the control slide 24, is possible when there is a connection with the supply line 19 controlled by the second magnetic valve 47'', and that even when the discharge is blocked a rapid pressure buildup of the control pressure $P_S$ will occur in this control pressure line 31.

Figure 5:
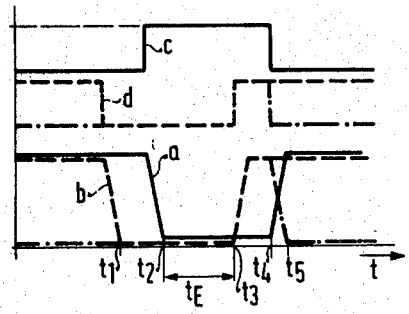
FIG. 5 is a control diagram for the magnetic valve assemblies shown in FIGS. 2–4.

The mode of operation of the two magnetic valves 46 and 47 of FIG. 2, as well as of the magnetic valves 46' and 47' and 46'' and 47'', respectively, of FIGS. 3 and 4, all shown in their position blocking the outflow of fuel from the control pressure line, may be understood with the aid of the diagram given in FIG. 5.

The closed position "zu" and the open position "auf" of the two magnetic valves 46 and 47, 46' and 47', and 46'' and 47'', respectively, are plotted on the ordinate over the time t plotted on the abscissa, by means of two curves a and b slightly shifted in height relative to one another. The solid-line curve a relates to the first magnetic valve 46, 46', 46'' and the broken-line curve b relates to the second magnetic valve 47, 47', 47''. As may be understood from curve b, at $t_1$ the second magnetic valve 47, 47', 47'' is already closed when at time $t_2$ the injection, identified by the symbol $t_E$, is initiated by the switchover of the first magnetic valve 46, 46', 46'' from its open position back to its closed position, that is, from "auf" to "zu". The injection is then terminated when at time $t_3$ the second magnetic valve 47, 47', 47'' opens and switches over from "zu" to "auf". Shortly thereafter, the first magnetic valve 46, 46', 46'' can switch back at time $t_4$ into its open position, so that before the onset of the closing movements of both magnetic valves which occurs at times $t_1$ and $t_2$ the two magnetic valves are open and the control pressure line 31 is relieved of pressure toward the low-pressure line 19. As a result of this so-called "counterpoint switching" of two magnetic valves, it is also possible to use conventionally available, pressure-compensated magnetic valves having a system-dictated minimum switching duration for attaining extremely short switching times, shortened virtually to zero. The switching times dictated solely by the stroke of the valve member are indicated by the oblique portion of the curves a and b, and the curves c and d indicate the electrical switching pulses for the associated electromagnet. As may be understood from curves c and d, the first magnetic valve 46, 46', 46'' is switched on shortly before time $t_2$ in order to control the onset of injection and is then switched off again at an instant which can be set within wide limits between time $t_3$ and time $t_2$. The broken-line curve d shows that the second magnetic valve 47, 47', 47'' is switched on at time $t_3$ in order to control the end of injection, and it is switched off again before time $t_2$, for instance at $t_1$ or, as indicated by dot-dash lines, at $t_5$.

Figure 6A:
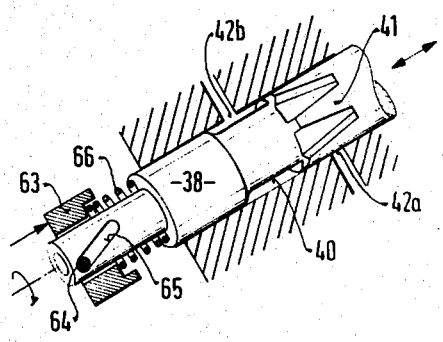
FIG. 6*a* is a perspective view of the rotary distributor used in the valve assembly of FIG. 6.
Figure 6:
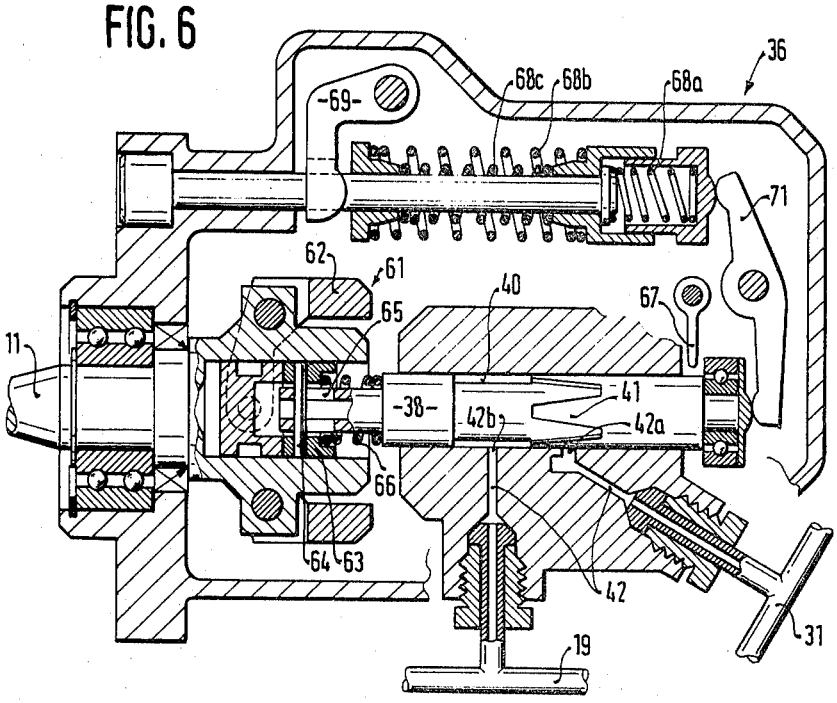
FIG. 6 is a partial cross section through the valve assembly used in FIG. 1.

FIG. 6 is a section taken through one practical embodiment of the valve assembly 36 which is only suggested in FIGS. 1 and 1*a*, along with the components which are of importance in the actuation of the rotary distributor 38, and FIG. 6*a* is a perspective view of the rotary distributor 38. A flyweight group 61 is inserted into the drive mechanism of the rotary distributor 38, the flyweights 62 exerting their force upon an adjusting sleeve 63, and the axial movement of the adjusting sleeve 63 effected in accordance with centrifugal force and counter to the force of the adjusting spring 66 causes a rotation of the rotary distributor 38 relative to its drive mechanism 11 which serves the purpose of varying the onset of injection. The recess 40 which is limited in one direction in the rotary distributor 38 by the control faces 41 communicates permanently via the control port 42*b* and a portion of the line 42 with the supply line 19, while the control port 42 which can be closed by the control faces 41 in order to control the duration of injection communicates with the control pressure line 31. The axial movement of the rotary distributor 38 affecting the supply quantity can be effected via a lever 67 in order either to shut off or to correct the supply quantity, while the initial adjustment of governor springs 68*a*, 68*b* and 68*c* can be affected via an adjusting lever 69. The transmission of the forces of the governor springs is effected via an intermediate lever 71.

Figure 7:
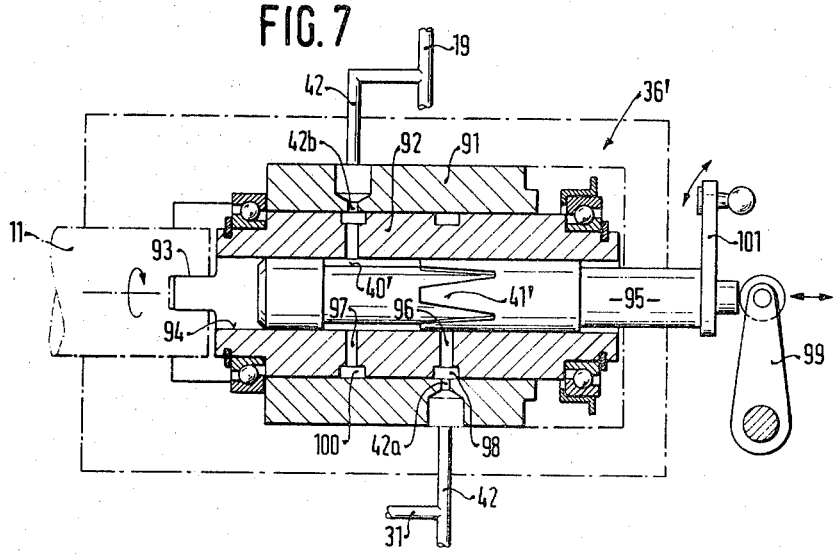
FIG. 7 is a simplified cross section through a variant embodiment of the valve assembly used in FIG. 1 and shown in greater detail in FIGS. 1*a*, 5 and 5*a*.

In FIG. 7, a variant embodiment of the mechanical valve assembly 36 used in FIGS. 1, 1*a*, 6 and 6*a* is shown. The valve assembly 36' of FIG. 7 includes within a stationary housing 91 a control sheath 92, acting as a revolving rotary distributor, which is driven either by a shaft indicated by dot-dash lines and revolving in synchronism with the engine camshaft 11 or, as is assumed in this exemplary embodiment, directly by the engine camshaft 11 via a coupling without play, preferably a diaphragm coupling. However, for the purpose of simplification, this coupling is shown as a claw coupling 93 shifted in position in the drawing by 45°. The control sheath 92, in a central longitudinal bore 94, receives a metering slide 95 which can be longitudinally displaced in order to vary the supply quantity or rotated in order to vary the injection onset but is otherwise stationary. The metering slide 95 is provided with the four control faces, here indicated as 41'. The control sheath 92, disposed concentrically about the metering slide 95, is provided with a control port 96 which is realized as a radial bore located in a plane perpendicular to the longitudinal axis of the control sheath 92. This control port 96 discharges into an annular groove 98 on the circumference of the control sheath 92, and the annular groove 98 in turn communicates via the control port 42*a* in the housing 91 with the portion of the line 42 leading to the control pressure line 31. The recess 40′ axially defined on one side by the control faces 41′ communicates permanently via radial bores 97 and an annular groove 100 in the control sheath 92 with the control port 42*b* in the housing 91 and thereby and via a portion of the line 42 with the supply line 19. The longitudinal displacement of the metering slide 95 required for the purpose of varying the supply quantity is effected via a lever 99, while the rotary movement required for the purpose of varying the injection onset is effected via a lever 101. Both levers may be actuated via known mechanical or electromechanical governors or injection adjusters; alternatively, hydraulic or electrohydraulic adjusting members may engage these levers 99 and 101.

The fuel injection apparatuses described as exemplary embodiments are provided exclusively with pump/nozzles, because the advantages of the hydraulic control according to the invention are best attained thereby. However, the principle of the invention may also be applied to single pumps and to injection pumps combined into series-type pumps.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection apparatus for internal combustion engines, in particular for Diesel engines, having per engine cylinder one mechanically driven pump piston of an injection pump and a pump work chamber in said injection pump supplied with fuel under supply pressure by a supply pump and preferably combined with an injection nozzle into a pump/nozzle unit, each apparatus having one control slide, said slide being limited by a pressure chamber and actuatable by the control pressure of a source of control fuel which is common to all the injection pumps counter to the force of at least one restoring spring, said control slide further being inserted into a discharge channel in permanent communication with said pump work chamber and arranged to close this discharge channel at will in order to initiate the variable onset of injection and further arranged to open said channel again in order to terminate the injection, said apparatus further including a control apparatus whereby pressure can be exerted via control lines upon said pressure chambers of said control slides, characterized by the following characteristics:

(a) said control fuel source is embodied by said supply pump dimensioned by a control pressure ($p_S$) increased severalfold over the supply pressure ($p_V$) of said injection pumps and by a first pressure limitation valve limiting the control pressure ($p_S$) in a control pressure line capable of being connected with said control lines;

(b) said first pressure limitation valve being correlated with a second pressure limitation valve, said second pressure limitation valve arranged to determine the supply pressure ($P_V$) prevailing in filling lines separate from said control lines;

(c) said control apparatus comprises a valve assembly common to all of said injection pumps said assembly arranged to determine the onset and duration of pressure upon said pressure chambers of said control slide, and a distributor means separate from said valve assembly arranged to communicate with said control lines leading to said pressure chambers of said control slides said means arranged to be connected at a predetermined time to said control pressure line in synchronism with said injections and further wherein;

(d) said control pressure ($p_S$) required for actuation of said control slides and exerted via said distributor means upon one of said pressure chambers at a time established by means of said valve assembly which blocks the discharge of control fuel out of said control pressure line into a low-pressure line and is subsequently relieved toward said low-pressure line for the purpose of effecting the return stroke of said control slide.

(e) said filling lines are connected to a supply line which is under supply pressure ($p_V$) and which is common to all of said injection pumps; and (f) said pump work chamber can be made to communicate with said filling line by means of an overflow channel controlled by a control location provided on said control slide.

2. A fuel injection apparatus as defined by claim 1, characterized in that said supply pump is embodied as a constantquantity pump.

3. A fuel injection apparatus as defined by claim 1, characterized in that said supply line serves as a low-pressure line for the fuel flowing out of said control pressure line via said valve assembly.

4. A fuel injection apparatus as defined by claim 1, characterized in that said filling line is connected to a spring chamber which contains said restoring spring and said control slide and therethrough to said overflow channel via channels in a section of said control slide.

5. A fuel injection apparatus as defined by claim 4, characterized in that said pressure chamber of said control slide communicates with said spring chamber via a throttle line which is preferably drilled entirely through said control slide.

6. A fuel injection apparatus as defined by claim 5, characterized in that said overflow channel can be made to communicate with a relief line by means of an annular groove on said control slide.

7. A fuel injection apparatus as defined by claim 1, characterized in that said valve assembly is embodied as a magnetic valve means.

8. A fuel injection apparatus as defined by claim 7, characterized in that said magnetic valve assembly comprises two magnetic valves arranged to be switched hydraulically in parallel, said first magnetic valve being open toward said low-pressure line prior to the onset of injection, and thereby arranged to block the outflow of said control fuel out of said control pressure line into said low-pressure line to initiate injection, and further that said second magnetic valve is arranged to block the outflow of said control fuel prior to the onset of injection as well as control the end of injection by means of a switchover movement.

9. A fuel injection apparatus as defined by claim 8, characterized in that said first and second magnetic valves are embodied as 3/2-way valves, and further that said control pressure line has a portion which communicates permanently with said distributor means, said portion also arranged to be connected in alternation with another portion of said control pressure line communicating with the source of control fuel as well as with said low-pressure line.

10. A fuel injection apparatus as defined by claim 8, characterized in that said first magnetic valve is embodied as a 2/2-way valve and is inserted into a further line connecting said control pressure line with said low-pressure line and that said second magnetic valve is embodied as a 3/2-way valve and is arranged to connect the first portion of said control pressure line leading to distributor means with said other portion of said control pressure line communicating with the source of control fuel as well as with said low-pressure line.

11. A fuel injection apparatus as defined by claim 8, characterized in that each of said magnetic valves of said magnetic valve assembly are embodied as 2/2-way valves, which are each inserted into another line connecting said control pressure line with said low-pressure line and alternatively arranged to control flow in said lines and further that a flow throttle is inserted into said control pressure line preferably between the source of control fuel and the connection with said last named lines containing said magnetic valves.

12. A fuel injection apparatus as defined by claim 8, characterized in that said first magnetic valve can be excited for its switchover movement triggering the onset of injection and blocking the connection from said control pressure line to said low-pressure line and further that said second magnetic valve can be excited for its switchover movement controlling the end of injection and relieving said control pressure line toward said low-pressure line.

13. A fuel injection apparatus as defined by claim 1, having a central rotary distributor serving as a distributor apparatus, which is driven in synchronism with the injection pumps and which in order to actuate the control slides establishes and interrupts the connection of the individual control lines with said control pressure line in sequence and in synchronism with the injections, characterized in that said rotary distributor includes a revolving jacket face provided with a control port permanently communicating with said control pressure line, said control port further having a predetermined width (B) dimensioned for the longest possible duration of actuation of said control slide.

14. A fuel injection apparatus as defined by claim 1, wherein said valve assembly further including a rotary distributor which is driven in synchronism with the injection pumps and is longitudinally displaceable for the purpose of varying the supply quantity and rotatable relative to its drive mechanism for the purpose of varying the injection onset, said distributor further arranged to control the control pressure actuating the control slides and thereby influence the connection from the opened control line to the low-pressure line by means of at least one control face in synchronism with the injections, characterized in that said valve assembly is inserted into a line connecting said control pressure line with said low-pressure line, and that said revolving rotary distributor has one control face on its jacket face per control line.

15. A fuel injection apparatus, in particular as defined by claim 1, wherein said valve assembly further including a rotary distributor which is driven in synchronism with said injection pumps and said valve assembly further arranged to control said control pressure actuating said control slides and influence the connection from the opened control line to said low-pressure line by means of one control face in synchronism with said injections, characterized in that said distributor means is embodied by a control sheath disposed concentrically about a metering slide, and further that said metering slide is provided with one control face per control line to be opened, said metering slide further arranged to be longitudinally displaceable to vary the supply quantity as well as rotatable to vary the injection onset.

16. A fuel injection apparatus as defined by claim 15, characterized in that said control sheath is provided with only one control port cooperating with a control face on said metering slide, said control port being arranged to discharge into an annular groove on the circumference of the control sheath.

17. A fuel injection apparatus as defined by claim 1, characterized in that said distributor means is provided with at least one control location, said control location including a connection from the associated control line to said control pressure line interrupted, at least in the bottom dead center position (UT) of said pump piston, and reestablished again after a first partial stroke ($h_1$) has been performed.

18. A fuel injection apparatus as defined by claim 17, characterized in that said control location is embodied by an annular groove machined into the jacket face of said pump piston.

* * * * *